United States Patent [19]

Gasquet et al.

[11] Patent Number: 4,676,520

[45] Date of Patent: Jun. 30, 1987

[54] LATCHING APPARATUS FOR A SKI BRAKE

[75] Inventors: Denis Gasquet, Annecy; Pierre Desarmaux, Metz-Tessy, both of France

[73] Assignee: Salomon S.A., Annecy, France

[21] Appl. No.: 581,726

[22] Filed: Feb. 22, 1984

[30] Foreign Application Priority Data

Feb. 23, 1983 [FR] France ..... 83 03631

[51] Int. Cl.[4] ..... A63C 5/00

[52] U.S. Cl. ..... 280/605

[58] Field of Search ..... 280/605, 809, 604

[56] References Cited

U.S. PATENT DOCUMENTS

| | | | |
|---|---|---|---|
| 3,924,864 | 12/1975 | Weigl | 280/11.13 |
| 4,350,364 | 9/1982 | Salomon | 280/605 |
| 4,352,506 | 10/1982 | Svoboda et al. | 280/605 |

FOREIGN PATENT DOCUMENTS

| | | |
|---|---|---|
| 364298 | 2/1981 | Austria . |
| 2429719 | 1/1975 | Fed. Rep. of Germany . |
| 2513188 | 10/1975 | Fed. Rep. of Germany . |
| 2502102 | 7/1976 | Fed. Rep. of Germany . |
| 2525945 | 12/1976 | Fed. Rep. of Germany . |
| 2652975 | 5/1978 | Fed. Rep. of Germany . |
| 8221957 | 10/1975 | France . |

*Primary Examiner*—John J. Love
*Assistant Examiner*—Richard Camby
*Attorney, Agent, or Firm*—Sandler & Greenblum

[57] ABSTRACT

Latching apparatus for a ski brake that has three elements: at least one braking element journalled on a base plate and movable between an active position, in which the braking element projects under the sole of the ski, and an inactive position, in which the braking element is raised with respect to the ski; an elastic system biasing the braking element toward the active position; and activation means for activating the braking element to move from the active to the inactive position in response to downward pressure from a boot on the activation means. The latching apparatus is a removable bar positioned either, between two of the movable elements of the brake or between the braking element and an element integral with the ski, to lock the braking element in its inactive position. The latching apparatus also includes an extension element, extending vertically above the bar, and positioned in front of the binding so as to block the insertion of the boot into the binding. In addition, the extension element is positioned between lateral edges of the ski above the sole of the ski so as to permit easy access to the sole of the ski and the edges of the ski for easy maintenance.

31 Claims, 26 Drawing Figures

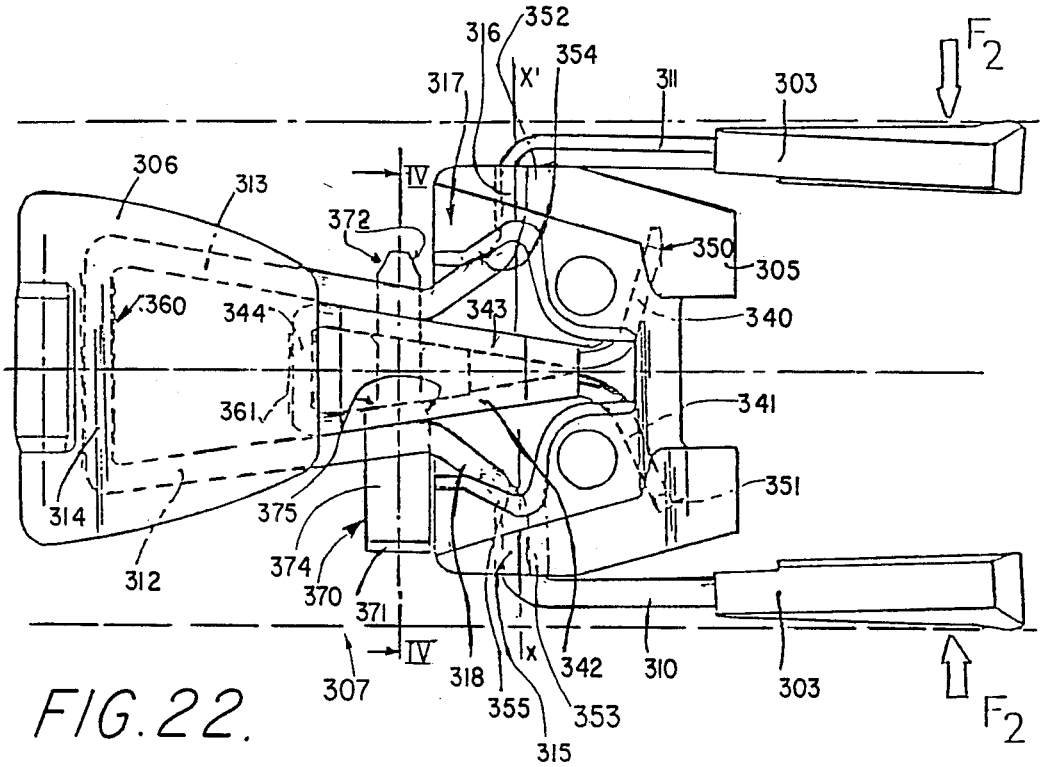
FIG. 22.
FIG. 23.
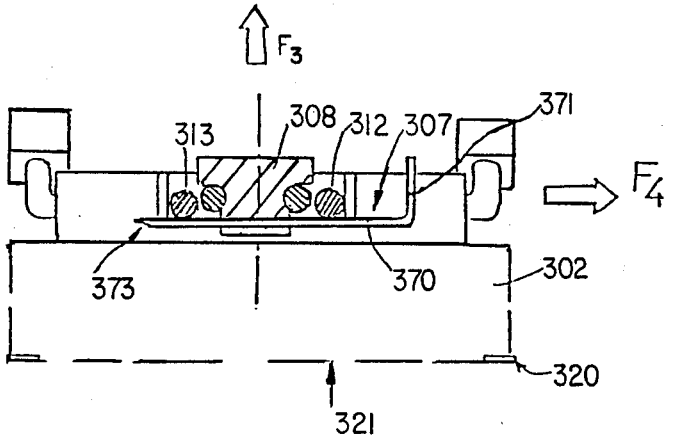

LATCHING APPARATUS FOR A SKI BRAKE

BACKGROUND OF THE INVENTION

1. Field of the Invention

The present invention relates to a latching apparatus for a ski brake.

2. Description of Prior Art

Ski brakes have been increasingly mounted on skis in recent years to replace safety straps which suffered from well known disadvantages. Such ski brakes generally comprise one or more brake elements, sometimes known as "spades". These brake elements are adapted to implant themselves in the snow so as to immobilize the ski when the ski is separated from the boot of the skier as a result of a fall. Ski brakes generally also comprise an elastic mechansim which automatically moves the brake elements into an active brake position in which these brake elements project beneath the ski during a release of the binding. Such ski brakes further comprise a pedal connected to the brake elements and on which the boot of the ski is supported, during reinsertion of the boot, so as to pivot the brake elements into an inactive position which allows for skiing. In the inactive position, the brake elements are raised above the ski so as to prevent them from interfering with skiing.

The majority of presently available brakes satisfactorily accomplish their braking function, but unfortunately suffer from a number of disadvantages. For example, because the brake elements or spades are biased to project under the lower surface of the ski, these elements prevent maintenance of the ski and more particularly, the maintenance of the slide surface, which entails, for instance, the waxing and sharpening of the edges. In addition, when the brake is deployed in the braking position, the brake occupies a substantial volume. As a result, the ski occupies a substantial volume which elevates the cost of the packaging of the ski. In addition, this substantial volume requires the retail outlet that displays the ski to rent more floor space to accommodate the larger volume of the skis and their storage boxes. Because commerical and industrial rents are very high, this also increases the cost of these skis.

To overcome these disadvantages ski brakes have been proposed which comprises at least one braking element journalled on a base plate and movable between a first, active position in which it projects beneath the ski and a second, inactive position in which it is lifted with respect to the lower plane of the ski. The braking element is moved from the first to the second position by the means of voluntary action of the skier on a pedal against the bias of an elastic system. This pedal, in the active position, projects above the ski and comprises a plurality of elements which are movable with respect to one another during movement from one position to the other. At least one of the movable elements is connected to the base plate and a movable latch is provided to block displacement of the other elements with respect to it.

For example, German Application No. A-2,502,102 discloses a device in which a pivotable element or rocker, mounted on the ski, prevents the brake from moving into the active position as long as the skier does not put on the ski. Once the boot is inserted onto the ski, the rocker retracts to free the brake which is no longer maintained in an inactive position other than by pressure of the boot of the skier who must then put on the ski in a rapid movement without any hesitation or interruption.

In the apparatus described in Austrian Pat. No. 364,298, the brake can be latched in the inactive position by a movable stirrup comprising an element preventing insertion of the boot in the latched position. This stirrup can be displaced only by hand. Besides its complexity, the apparatus is relatively cumbersome and extends considerably beyond the lateral edges of the ski. This is disadvantageous because when this ski is transported there is a risk that the stirrup will catch and hook onto other materials. In addition, this protruding stirrup renders the sharpening of the edges of the ski corners particularly difficult.

Another latch for a ski brake is described in German Application No. A-2,429,719. Besides its considerable complexity and vulnerability to snow and freezing by virtue of the numerous rotating and sliding elements, this ski does not prevent insertion of the boot in the latched position.

For obvious reasons of safety, standards provide (e.g., DIN 7885-6.1.5) that the brake can be latched or placed out of operation to allow the ski to be worked upon, on the condition that this shut-down is the result of a well defined and characterized manipulation and cannot occur other than by means of a special tool. Furthermore, the latching apparatus, when it is in an active position, must necessarily prevent all insertion of the boot onto the ski.

German Application No. A-2,652,975 discloses a type of spring clip, which is adapted to be attached to the ski. In addition, it aids in the transportation and storage of the ski by surrounding the ski, and at the same time prevents the brake from moving into an active position. This apparatus is difficult to maneuver and resting on the lower surface of the ski, prevents all work on the edges of the ski and on the sole. It thus does not satisfy to the needs of the skier.

Finally, French Application No. 82 21 957 discloses a particularly simple apparatus which allows for the latching of the brake so as to allow for maintenance work, but it does not render insertion of the boot impossible in the latched position.

SUMMARY OF THE INVENTION

The present invention overcomes the insufficiencies of the prior art with respect to the standards referred to above by providing an apparatus of extremely simple design which does not interfere with the maintenance work that should be done on the edges and the sole of the ski.

In one embodiment, the invention is an apparatus for a ski brake. The brake is adapted to move from an inactive to an active position. In the active position, the brake brakes the ski after the release of the boot from the binding of the ski. In this type of ski, the boot passes through a zone above the ski when inserted into the binding. The apparatus comprises a latch adapted to be attached to the ski brake and means for preventing insertion of the boot into the binding. This means is attached to the latch and permits substantially free access to the edges of the ski. This means may comprise an extension element, adapted to extend into this zone when the latch is attached to the brake.

The latch may be removable from the ski brake and the extension element may extend substantially vertically upward above the ski. In addition, the extension is adapted to extend into the zone when the latch is attached to the brake, and the extension may be positioned between the lateral edges of the ski so as to permit substantially free access to the edges of the ski for the maintenance thereof. In addition, the extension element may be integral with the latch. In one embodiment, the extension element comprises a means for extending into the above-mentioned zone only when the brake is in the inactive position.

In addition, the extension element extends substantially perpendicular to the latch, and the latch is removable from the brake. In one embodiment, the latch may comprise an inverted substantially T-shaped bar. Alternatively, the latch may comprise a manipulation element adapted to be manipulated by the skier to remove the latch from the brake. In this embodiment, the extension comprises this manipulation element.

In another embodiment, the longitudinal axis of the latch means extends substantially parallel to the longitudinal axis of the brake when the brake is in the inactive position.

In still another embodiment, the ski comprises a sole, and the brake comprises three elements. The first element comprises at least one braking element journalled on a base plate and movable between the active and inactive position. In the active position, the braking element projects under the sole of the ski. In the inactive position, the braking element is raised with respect to the sole of the ski. In addition, the brake also comprises an elastic means for biasing the braking element toward the active position. Finally, the brake also comprises an activation means for activating the braking element to move from the active to the inactive position in response to the boot acting on the activation means against the bias of the elastic means. In addition, the activation means is adapted to be positioned in an active position above the ski. The brake, therefore, comprises at least two movable elements. In such a brake, the latch may comprise a removable bar positioned between the two movable elements to maintain the braking element in the inactive position.

In an alternative embodiment, the ski comprises an element integral therewith, and comprises the elements noted above in the previous enbodiment. In such an embodiment, the latch comprises a removable bar positioned between the braking element and the element integral with the ski so as to maintain the braking element in the inactive position. In addition, the bottom of the apparatus of the present invention may be positioned above the sole of the ski so as to permit easy maintenance of the sole of the ski.

In still another embodiment, the invention comprises a latching apparatus for a ski brake. In this embodiment, the ski has lateral edges, and the ski brake brakes the ski after release of the boot from the binding of the ski. The brake is adapted to move between an active and an inactive position. In such a ski brake, the latching apparatus comprises locking means for locking the brake in the inactive position, and blocking means for blocking insertion of the boot into the binding. The latching apparatus is positioned between the lateral edges of the ski. In addition, the blocking means may be positioned in front of the binding.

In addition, when the boot is inserted into the binding, it passes through a zone above the ski. The blocking means is positioned in this zone so as to block the insertion of the boot into the binding.

In one embodiment, the blocking means is attached to the locking means, and the locking means is removable from the brake. In addition, the blocking means may comprise a bar substantially perpendicular to the longitudinal axis of the locking means. Alternatively, the latching apparatus may comprise an inverted, substantially T-shaped bar. In addition, the bottom of the apparatus in this embodiment is positioned above the sole of the ski so as to provide for easy maintenance thereof.

In this embodiment of the latching apparatus that comprises a blocking means, the apparatus may be used with the ski brake discussed above that comprises the at least one braking element journalled on a base plate, the elastic means, and the activation means. In this embodiment, the locking means comprises a removable bar positioned between two movable elements of the brake to maintain the braking element in the inactive position.

In still another embodiment, the invention comprises an apparatus for a ski brake which brakes a ski after release of the boot from a binding on the ski. The brake is adapted to move from an active to an inactive position, and the ski comprises edges. In the apparatus used with this type of ski brake and ski, the apparatus comprises latching means for latching the brake in the inactive position; and means for preventing the insertion of the boot into the binding when the boot is in the inactive position. The apparatus is adapted to permit substantially free access to the edges of the ski so that the edges can be easily maintained.

The insertion prevention means may be attached to the latching means, and may comprise an element positioned in front of the binding to block the entry of the boot into the binding. This element may be positioned between the lateral edges of the ski. In addition, the bottom of the apparatus may be positioned above the sole of the ski, and the apparatus itself may be removable from the brake.

Insertion prevention means may also comprise a bar, extending substantially vertically above the ski when the latching means latches the binding in the inactive position. Alternatively, the apparatus of the present invention may comprise an inverted, substantially T-shaped bar.

This apparatus, comprising the latching means and the insertion prevention means may be used with the ski brakes discussed above. More specifically, the latching means may be positioned between two movable elements of the ski brake or between an element integral with the ski and the braking element to prevent relative movement therebetween and to maintain the braking element in the inactive position. The latching means may comprise a removable bar.

BRIEF DESCRIPTION OF THE DRAWINGS

The invention will now be described with reference to a plurality of embodiments in the detailed description that follows with reference to the attached drawings given by way of non-limiting example only, in which:

FIG. 8 illustrates a view of one embodiment of the braking assembly as viewed from the tail of the ski and in the braking position;

FIG. 9 illustrates a cross-sectional view taken along line II—II of FIG. 8;

FIG. 10 illustrates a side view of the braking mechanism in an intermediate retracted position;

FIG. 11 illustrates the ski brake in the fully retracted position;

FIG. 12 is a side view of the ski brake of FIG. 6 in the of the braking position;

FIG. 13 is a top view of the ski brake illustrated in FIG. 12;

FIG. 14 is a side view of the brake in the skiing position;

FIG. 15 is a top view of the ski brake illustrated in FIG. 14 with the ski boot removed for clarity;

FIG. 16 is a cross-sectional view taken along line V—V in FIG. 15;

FIG. 17 is a perspective view of a detail of the ski brake illustrated in FIGS. 12–16;

FIGS. 18 and 19 are perspective views showing the ski brake in the braking and skiing positions;

FIGS. 20–26 illustrate the ski brake illustrated in FIGS. 1–4 in more detail;

FIG. 20 is a side view of the ski brake in the braking position;

FIG. 21 is a side view of the ski brake in the skiing position;

FIG. 22 is a top view of the ski brake in the skiing position illustrated in FIG. 21;

FIG. 23 is a cross-sectional view taken along line IV—IV in FIG. 3;

FIG. 24 is a perspective schematic view of several elements of the ski brake;

FIG. 25 is a side schematic view of the ski brake; and

FIG. 26 is a side schematic view of only several elements of the ski brake of the present invention.

DETAILED DESCRIPTION OF PREFERRED EMBODIMENTS

The various brake constructions generally encountered are well known to those of ordinary skill in the art and will not be described in any detail in this application because they are well known, and because the invention is not limited to any one particular brake.

Referring to FIGS. 1–4, a braking apparatus is illustrated, which is connected to a rear binding. The binding is illustrated in a general fashion but without reference mumerals. This braking apparatus, which is described in French Application No. 82 21 957, the disclosure of which is herein incorporated by reference, and which is well known, comprises a braking stirrup 1, journalled on a base plate. Stirrup 1 is biased towards its active position shown in FIG. 1 by an elastic system 2 connected to stirrup 1 by an activating element 3. The pressure of the boot on activating element 3 causes the braking apparatus to move from the active braking position (shown in FIG. 1) to the inactive position (shown in FIG. 2, in which the boot is illustrated, and FIG. 3). During this movement, the three elements 1, 2, 3 are movable with respect to one another. In the inactive position the sharpening of the edges and the maintenance of the sole of the ski can be performed if the braking apparatus is latched or locked in this inactive position.

Figure 1:
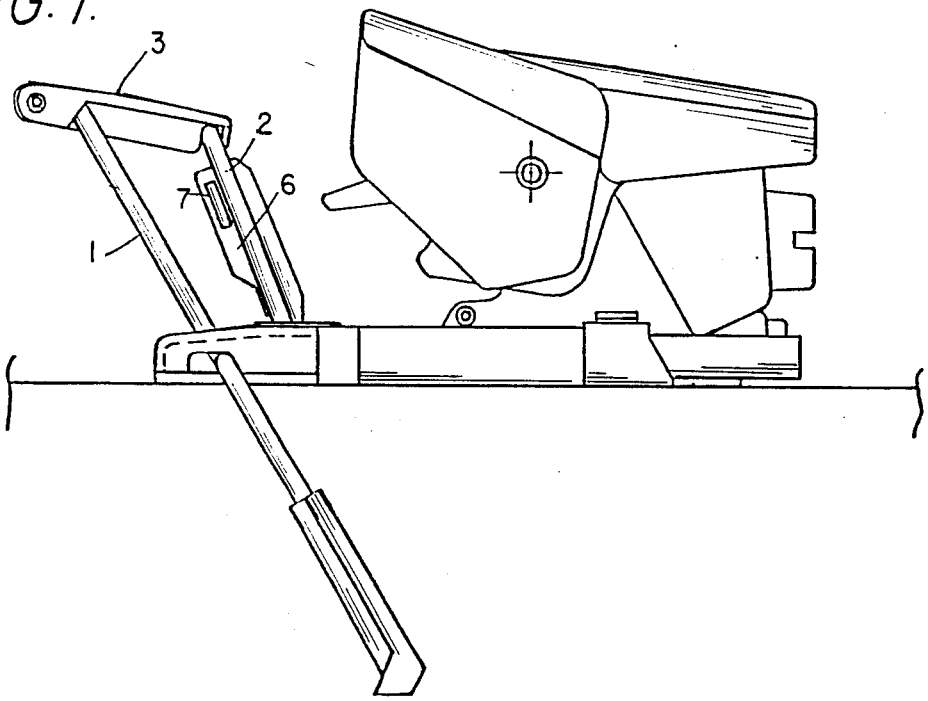
FIGS. 1 and 2 illustrate a side view of a first embodiment of the invention, in which a known brake is shown is in the active position in FIG. 1 and in the latched position in FIG. 2.
Figure 2:
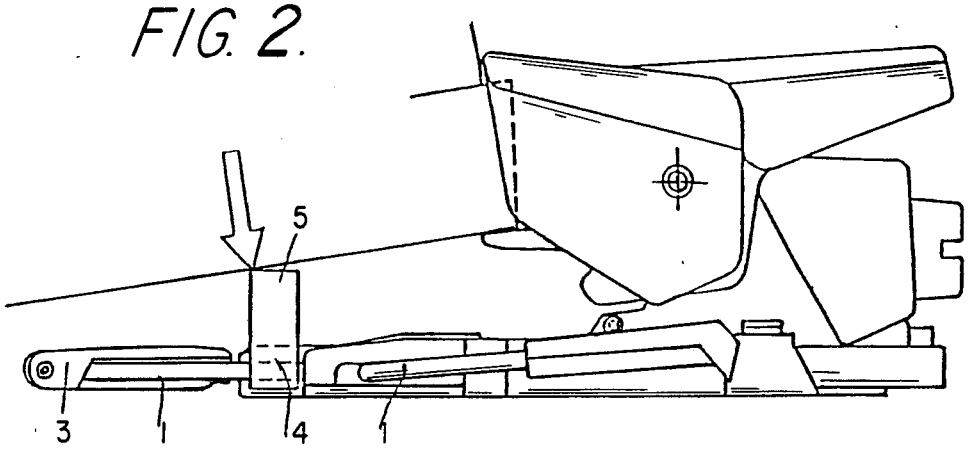
Figure 3:
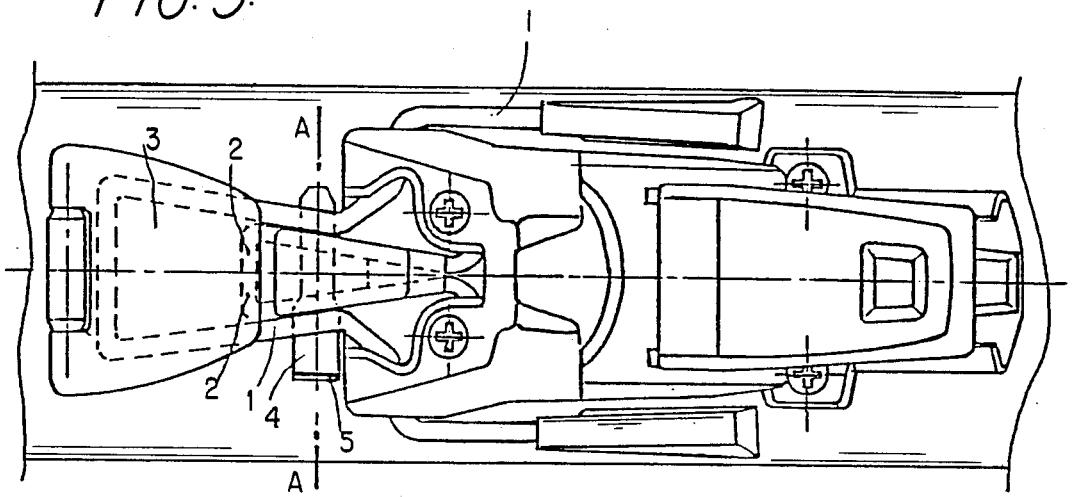
FIG. 3 is a top view of the embodiment shown in FIGS. 1 and 2.
Figure 4:
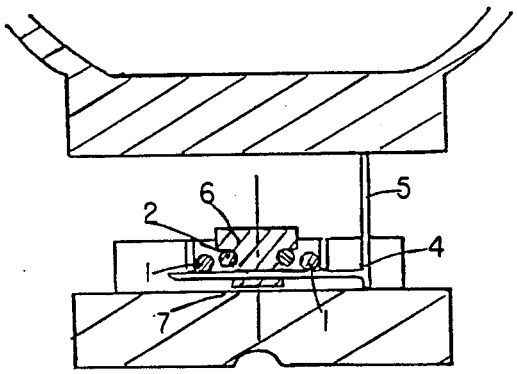
FIG. 4 is a partial cross-sectional view along line AA of FIG. 3.

To latch or lock the brake in the inactive position, a known removable bar or lock or latch 4 is provided. Latch 4 comprises a tool, separate from the brake itself. Latch 4 prevents the movement of two of the three elements 1, 2, and 3 with respect to one another. For example, as shown in FIGS. 1–3, elements 2 of the elastic system is blocked from movement with respect to stirrup 1. To accomplish this, element 2 is connected to a projecting element 6 having a transverse slot 7. Once the apparatus has been placed in the inactive position, bar 4 is introduced into this slot 7 under the arms of stirrup 1 and prevents any displacement of movable elements 1 and 2 with respect to each other, and thus, bar 4 prevents the movement of the braking assembly into the active braking position.

In the prior art brakes, bar 4 as positioned, does not prevent insertion of the boot. According to the present invention, on the other hand, an extension 5 is provided which is shown particularly in FIGS. 2 and 4. The longitudinal axis of extension 5 is preferably substantially perpendicular to the longitudinal axis of bar 4. In addition, extension 5 is sufficiently long to project into a zone which is necessarily swept by the boot when the boot is inserted into the binding on the ski, and thus renders insertion of the boot impossible. In addition, latch 4 and extension 5 do not extend beyond the lateral edges of the ski and are spaced from the sole of the ski so that they permit substantially free access to the lateral edges and the sole of the ski. In addition, this blocking of insertion of the boot into the binding occurs even though the elasticity of the rear binding normally allows for insertion of the boot when a layer of snow is present on the base plate or under the sole of the boot.

Although latch 4 and extension 5 form one integral element in this embodiment, it is within the scope of the invention to separate the two functions of latch 4 an extension 5. Thus for example, there may be separate means for locking or latching the brake in the inactive position and for preventing or blocking insertion of the boot into the binding.

The brake illustrated in FIGS. 1–4 is more clearly illustrated in FIGS. 20–26. These figures show a brake 301 in the form of a stirrup. The extremities of brake 301 are folded in the longitudinal direction to form braking elements 310 and 311. In addition, brake 301 is composed of an elastic steel wire having a cylindrical cross-sectional configuration of 3–5 mm diameter. The ends of elements 310 and 311 comprise plastic tips 303. Also, the brake comprises an elastic system which biases the brake in the active position illustrated in FIG. 20. The elastic system comprises a bias-producing loop 304 composed of elastic steel wire in the shape of an omega comprising two free ends 340 and 341. Free ends 340 and 341 converge toward each other and are pivotally mounted in a plate of base 305. Converging ends 340 and 341 cause loop 304 to be biased in their raised position illustrated in FIG. 21.

Ends 340 and 341 are held in joint pedestals 350 and 351 of the base plate. Two diverging branches 342 and 343 extend, respectively, from ends 340 and 341, and are joined together by transverse branch 344.

The upper part of the stirrup comprises two diverging brances 312 and 313 that are joined together by transverse branch 314.

Loop 304 is attached to brake 301 by an activating element 306. The pressure of the boot on element 306 causes displacement of the brake from its active position illustrated in FIG. 20 to its inactive position illustrated in FIG. 21. In addition, branches 314 and 344 are pivotally mounted on pedestals 360 and 361 on the lower part on element 6. As a result, the energy stored in loop 304 can be transferred to brake 301 to maintain the brake in its position illustrated in FIG. 20. In order for brake 100 to be displaced from its position in FIG. 20 to its position illustrated in FIG. 21 brake 1 must pivot around axis XX'. This pivoting can be caused by two projections 315 and 316 which are pivotally mounted, respectively, in housings 352 and 353 of base plate 305. Projection 315 is attached to branch 313 by a projection 317, while projection 316 is attached to branch 312 by a projection 318. Projections 317 and 318 converge toward the front of FIG. 22.

Figure 20:
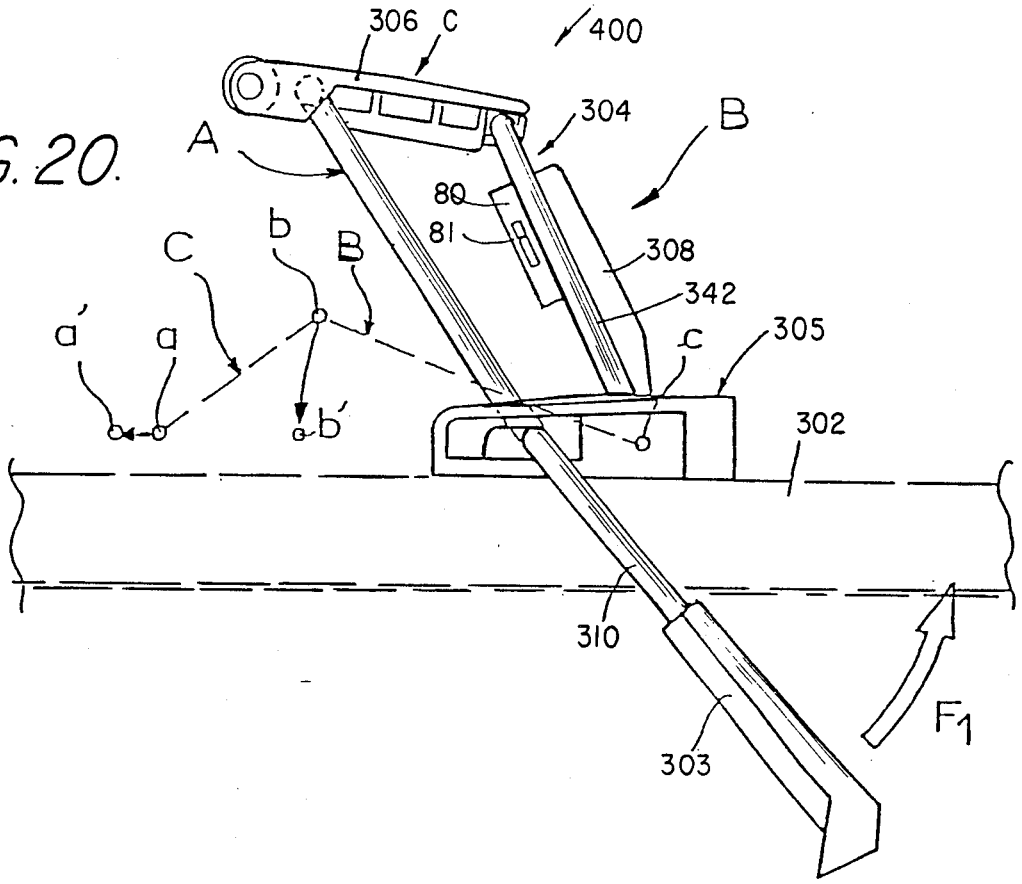
Figure 21:
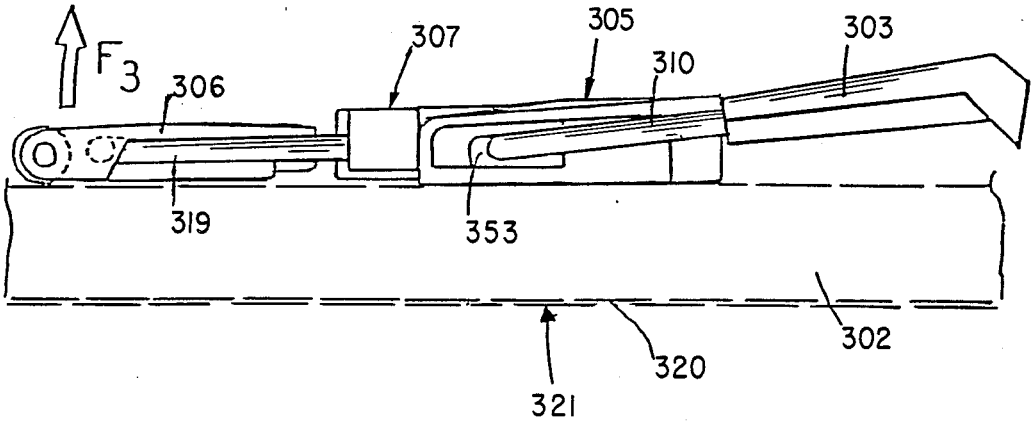
Figure 24:
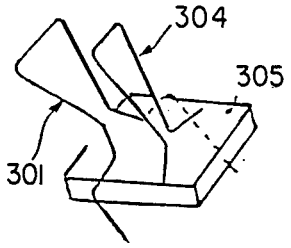

The displacement of the brake from its active position to its inactive position occurs at first, by the vertical pivoting in direction F1 of the lower end of elements 310 and 311, called the spades of the brake, and then by the transverse displacement in the direction of arrow F2 from the position illustrated by dotted lines in FIG. 20. Element 306 and loop 304 form a system comprising three points a, b, and c. When points a and b are displaced, respectively, to points a' and b' the brake moves forward into its inactive position. Further the inclination of projections 317 and 318 and their cooperation, respectively, with ramps 354 and 355 of the base plate results in the displacement of spades 310 and 311 toward each other to assume its inactive position illustrated in FIGS. 21 and 22.

In FIGS. 20–23 ski 102 is represented by dotted lines, and as has been discussed above spades 310 and 311 are adapted to be lifted vertically in the direction of arrow F1 and are adapted to be displaced laterally in the direction fo arrow F2. By positioning the brake in its inactive position, the brake permits sliding surface 321 of the ski to be maintained by the skier and permits portions 320 of the ski to be sharpened by the skier.

Mobile bolt 307 locks the two mobile spade 310 and 311 with respect to each other in their inactive position. Mobile bolt 307 comprises a metal element comprising one locking portion 370, and a portion 371 extending perpendicular to portion 370. Portion 371 serves to manipulate portion 370.

Figure 26:
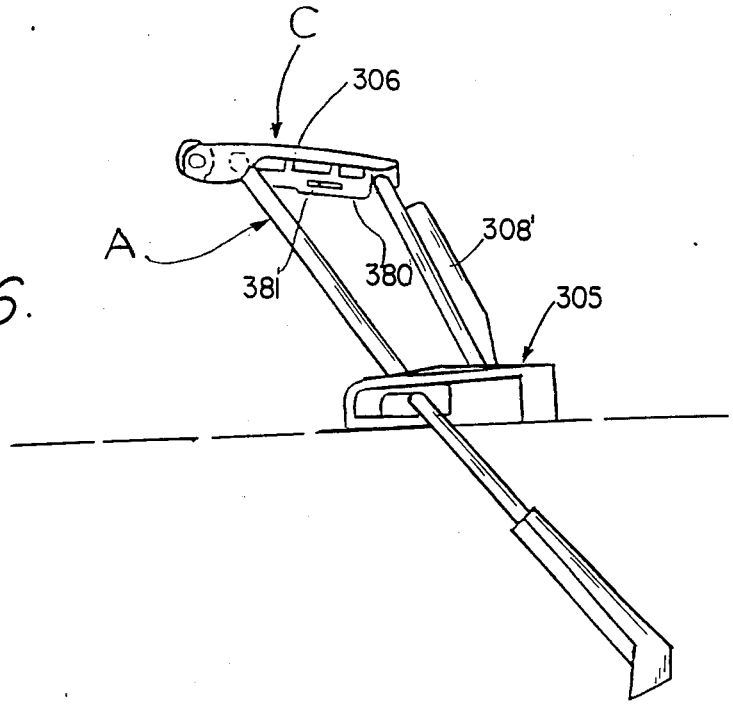

The brake further comprises an activating pedal 400 comprising three elements A, B, and C, as illustrated in FIG. 20. Element A comprises an upper portion of the brake and is composed of elements 318–19, and 317–19'. Element C comprises activating element 306, and element B comprises loop 304. When the brake is displaced from its active position to its inactive position during skiing these three elements A, B, and C are mobile with respect to each other. To bolt the brake in its inactive position as illustrated in FIGS. 2 and 3 it is sufficient to block the displacement of one of these three elements with respect to the other two elements. For example, elements B and C can be blocked with respect to element A, or element B can be blocked with respect to element C. In the illustrated embodiment element B is blocked with respect to element A by mobile bolt 7, and more precisely with element 370. In this connection loop or stirrup 4 further comprises portion 308 which extends downwardly by a spring 380 having a transverse opening 381 as illustrated in FIG. 26. In order to bolt the brake in its inactive position the skier places the end of portion 370 of bolt 307 into opening 381 in spring 380. In its bolted position the pedal, although it is pulled upward in the direction of arrow F3 in FIG. 21, the pedal cannot become unlocked. As a result, the brake remains in its inactive position. In effect, portion 308 is pulled upward in the direction of arrow F3, thereby dragging bolt portion 370 in this direction. However portion 370 abuts branches 319, 319' to block the unlocking of the pedal A, B, and C. In order to free the brake, one unlocks the bolt by pulling portion 371 of the bolt in the direction of F4 as illustrated in FIG. 23.

The extremity of bolt 307 comprises two edges 372 and one smaller edge 373 to facilitate insertion of portion 370 into opening 381. In addition, portion 370 comprises a large portion 374 comprising abutment 375 which limits the passage of bolt 307 in opening 381.

Figure 25:
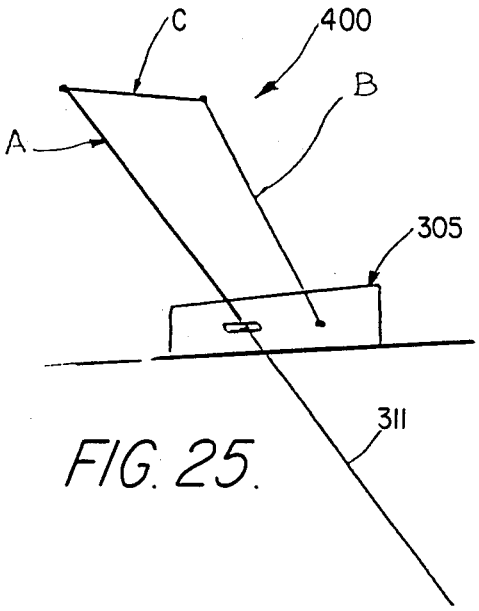

FIG. 25 illustrates an embodiment in which element B of pedal 400 is tied to base plate 305. In accordance with the previous embodiment the bolt blocks both elements A and B. However it is also within the scope of the invention to block both elements A and C, or even both of elements B and C as long as elements A, B, C, and 305 form a closed chain.

Figure 5:
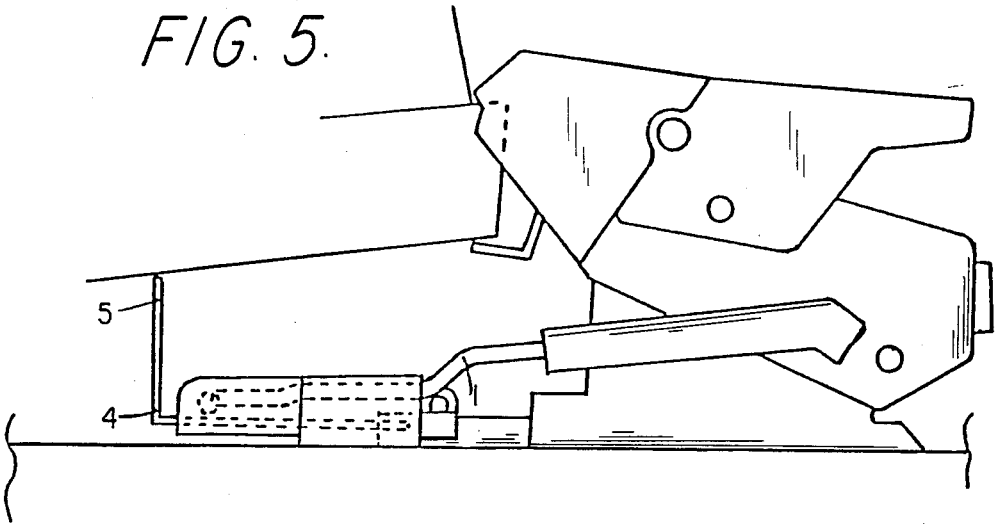
FIG. 5 illustrates a side view of another embodiment of the invention used with another known type of brake.

FIG. 5 illustrates the type of brake discussed in French Application No. 2,460,690, the disclosure of which is hereby incorporated by reference, and which need not be described in detail. The present invention, in this type of brake, comprises a bar tool or latch or lock 4, whose longitudinal axis is disposed substantially in the longitudinal direction from the front to the rear of the braking assembly in the inactive position, to block the movable elements from cooperating with the positioning of stirrup 1 into the active position. According to the invention, bar or latch 4 has an extension 5 which, is, for example, disposed substantially vertically and which, in this position, will project upwardly into a zone swept by the boot (illustrated in FIG. 5), when the boot is inserted into the binding, thereby rendering insertion of the boot into the binding impossible.

The brake shown in FIG. 5 is further illustrated in FIGS. 8–11. These figures show a ski brake 100 having a support plate or mounting member 102 which curls over lateral edges overlapping the edges on a guide rail member 107 fixedly secured to the upper surface **111*a* of ski 111. Ski brake 100 is adjustable along the length of guide rail member 107 in the longitudinal direction of ski 111 so as to facilitate an adjustment to different size ski boots 109** and together with the ski binding perform all thrust-balancing movements.

Support plate 102 has a rectangular shape of uniform thickness. Its length is dimensioned to correspond to the breadth of guide rail 107 so that the earlier mentioned adjustment in the longitudinal direction of ski 111 is possible. The longitudinal end region at one end of support plate 102 has on each side a bearing part **102*a* for receiving the ends of an erecting spring 108 therein, which spring will be described in more detail below. The bearing part 102*a* is closed at the front in the direction of arrow 111*b* which points toward the tip of the ski as well as being closed toward the rear, so that only the end regions of bearing 102*a* are open and receive the bent end segments 108*a* of erecting spring 108** therein.

Ski brake 100 comprises support member 104, operating plate 106, two brake plates 110 and a further spring which is preferably designated at leaf spring 105.

Figure 8:
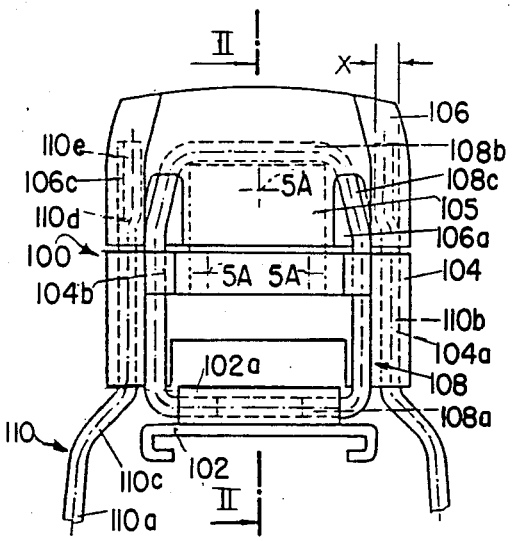
FIGS. 8–11 illustrate one embodiment of the ski brake of FIG. 5 in more detail.

Erecting spring 108 has in the rear view of FIG. 8 an inverted U-shaped configuration. In the relaxed position thereof, its two end segments **108*a* define with the plane of the remaining parts of the erecting spring an angle alpha. The sizes of angle alpha controls the desired magnitude of the erecting force for ski brake 100. The larger the angle, the higher the erecting force or the higher the initial tension becomes in the retracted position. Furthermore, end segments 108***a* of erecting spring 108 are positioned in the relaxed position at an angle beta to one another. Erecting spring 108 is, in the region of its end segments 108*a*, received in two bearing parts 102*a* on support plate 102. Further, erecting spring 108 is guided on the underside of operating plate 106 in a manner which will be described below.

Figure 9:
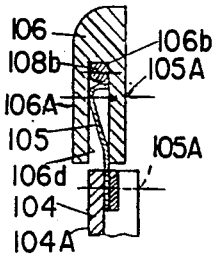

Operating plate 106 is manufactured of a sheet metal and/or a plastic and other suitable material and has uniform thickness and a rectangular shape. The laterally spaced regions of operating plate 106, which regions oppose the two side surfaces of ski 111, when the braking mechanism is in its retracted position, each have a recess 106*a* therein for receiving two individual legs 108*c* of erecting spring 108. The two legs 108*c* of erecting spring 108 are connected through a cross-bar segment 108*b*, which is received in a recess 106*b* in the edge of the operating plate 106 facing support part 104. One end of leaf spring 105 is secured to support member 104, and the other end is secured to the operating plate 106 in recess 106*b*. Leaf spring 105 is, at both ends, riveted to support member 104 and operating plate 106 as schematically shown at 105A. Leaf spring 105 has in its relaxed position, viewed from the side or in the longitudinal cross-sectional view, a doubly bent form which gives the spring an approximately S-shaped configuration. Leaf spring 105 urges a plane of top surfaced 106A of operating plate 106 to a position which is offset from the plane of top surface 104A of support member 104, as illustrated in FIG. 9. For this reason, and because operating plate 106 is at the same time also biased by erecting spring 108, it is sufficient if leaf spring 105 produces a smaller force in relationship to the force of erecting spring 108. It may, if needed, also be as great as or greater than the force of the erecting spring.

Support member 4 has also a substantially rectangular shape, and forms two laterally spaced regions of support 4, which are in alignment with the laterally spaced regions of operating plate 106. To receive two legs 108*c*, support member 104 has on its two lateral sides cylindrical passageways 104*b* extending therethrough.

Figure 10:
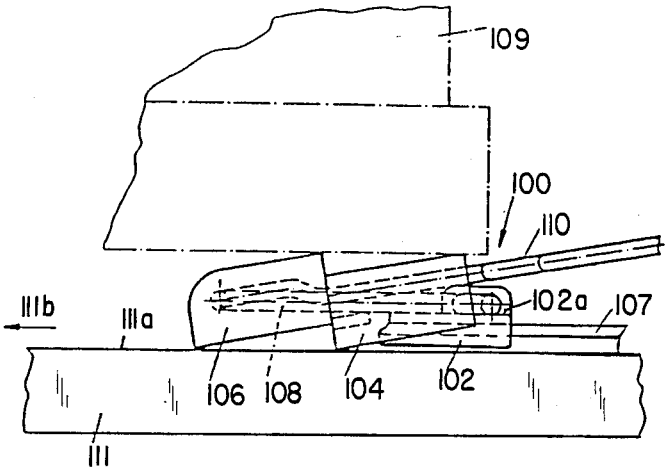

Each of two braking legs 110 has a section which functions as a braking mandrel 110*a*. Each braking mandrel 110*a* has in the region of its free end a conventional, plastic cover. A first bent segment 110*c* follows the braking mandrel 110*a* and extends at an acute angle with respect thereto. An axially extending segment 110*b* follows at another acute angle with respect to the first bent segment 110*c*. The braking leg 110 is, with the help of axially extending segment 110*b*, supported for a limited amount of rotation about the axis of the segment 110*b* in cylindrical bearings 4*a* and support member 104. Braking mandrel 110*a* and the axially extending segment 110*b* both extend parallel with respect to the longitudinal axis of the ski when the braking mechanism is in its retracted position. A second bent segment 110*d*, which extends in the direction toward the central axis of the braking mechanism, follows segment 110*b* at an angle of approximately 45°, which angle is not identified in any greater detail. Furthermore, the second bent segment 110*d* projects at an angle of approximately 45° from the plane of the leg segments 110*a*, 110*b*, and 110*c* in the direction away from ski 111 as shown in FIG. 10. An operating segment 110*e* of braking leg 110 follows the second bent segment 110*d* and extends parallel to the longitudinal axis of ski 111 when the braking mechanism is in its retracted position.

Operating segment 110*d* of each braking leg 110 is received in the recess 106*c* of plate 106 by means of second bent segment 110*d* which extends in a direction toward the center of the ski.

Ski brake 100 is held in its upright braking position by an erecting spring 108. Erecting spring 108 is thereby in a relaxed condition, or if desired, an initially tensioned position. Operating plate 106 carries along support member 104 through the connection provided by braking legs 110 and holds both structural parts in a pivotally supported relation about bearing part 102*a*. As can be seen in FIGS. 9 and 10, leaf spring 105 holds operating plate 106 in the aforesaid offset relationship with respect to support member 104. Leaf spring 105 is thereby in its relaxed position. Due to the difference in height which operating plate 106 is in with respect to support member 104, and due to the cooperation of hole 106*c* in plate 106 with the second bent segment 110*d* and the offset operating segment 110*e*, the two braking legs 110 are in the position illustrated in FIG. 8, namely, segments 110*a* are positioned on opposite lateral sides of the ski spaced from the lateral edges of the ski. In order to make this position possible, the two recesses 106*c* are required in the operating plate 106 to receive segments 110*d* and 110*e* of braking leg 110 therein.

Figure 11:
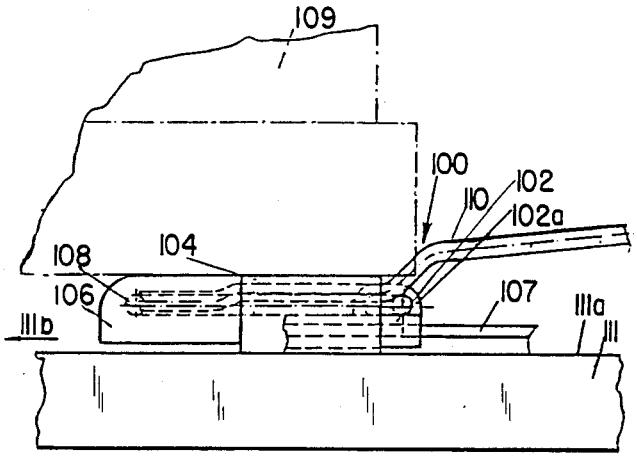

If a force is applied onto the ski brake by ski boot 109, schematically illustrated in FIGS. 10 and 11, the entire ski brake 100 is pivoted about ends 108*a* of spring 108 in bearing parts 102*a*. A relative movement against the force of spring 105 between the operating plate 106 and support member 104 does not initially take place. Only after support member 104 rests on upper surface 111*a* of ski 111 and the force from ski boot 109 continues to be applied onto operating plate 106, does a relative movement occur between operating plates 106 and support member 104 against the urging of spring 105 with the operating plate moving in approximately a vertical direction toward the ski to thereby tension leaf spring 105. Braking mandrels 110*a* which up to now only spring outwardly, are cranked or rotated in above the ski edges each approximately at a 90° angle through this movement. The upper surface of the operating plate 106 is now flush with upper surface of support 104, as seen in FIGS. 10 and 11.

When the force which is produced by ski boot 109 or on a ski boot having a sole plate secured thereto terminates, both leaf spring 105 and erecting spring 108 try to attain their relaxed position illustrated in FIG. 8. Leaf spring 105 which only has to overcome the mass inertia of operating plate 106 and the two braking legs 110, quickly and faster than spring 8, assumes its relaxed position. Thus, for the present, only the two braking mandrels 110*a* are swung out beyond the lateral edges of the ski. Only thereafter does erecting spring 108 which engages plate 6, swing the entire brake 100, through the connection provided by braking legs 110, about the axis of bearing part 102*a*. In this manner, the undesired snagging of the brake mandrels 110*a* on each braking leg 110 or of the braking blades arranged on individual braking mandrels 110*a* on the edges of the ski is prevented.

As is readily apparent from FIG. 9, leaf spring 105 serves at the same time as a bearing part for the cross-bar segment 108*b* of the erecting spring 108 in the operating plate 106, so that the region of leaf spring 5 adjacent operating plate 106 is received in recess **106*b* in operating plate 6, and is bent on its end facing the cross-bar segment 108*b* of erecting spring 108**.

Figure 6:
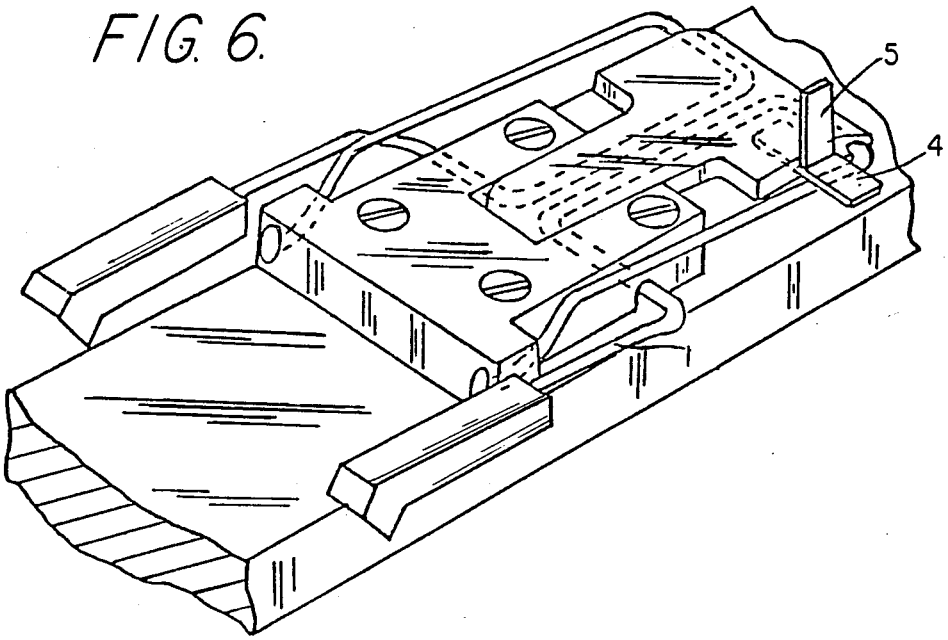
FIGS. 6 and 7 illustrate two additional applications of the invention to two additional types of known brakes.

FIG. 6 illustrates another embodiment of a bar or latch or lock 4 according to the invention. The braking apparatus in FIG. 6 is of the type which is known and described in French Application No. 2,451,751, which is hereby incorporated by reference. The manner by which this braking apparatus is latched is also known as well, and for further detail, one is referred to this document. According to the invention, known bar or latch 4 is replaced, with ample provision made for necessary constructional details, by an upsidedown or inverted T-shaped element whose median bar 5 projects upwardly, in order, as in the previous case, to create an obstacle in the zone which must necessarily be swept by the boot when the boot is inserted into the binding on the ski. The insertion of the boot into the binding is impossible as long as bar 4 and 5 is in place.

The ski brake illustrated in FIG. 6 is more fully illustrated in FIGS. 12–19.

Figure 12:
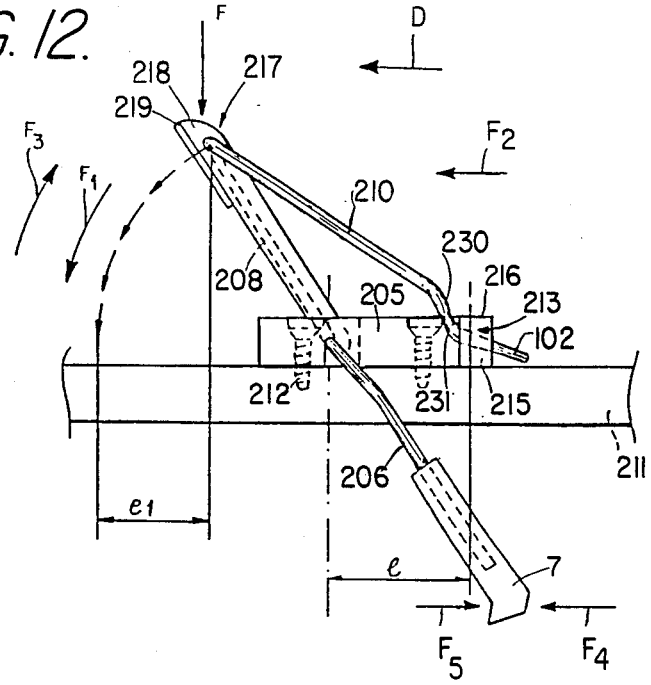
FIGS. 12–19 illustrate the embodiment of the ski brake of FIG. 6 in more detail.

As shown in FIGS. 12–19, the ski brake illustrated therein is adapted to be mounted on ski 211 that normally moves forwardly in a direction indicated at D in FIG. 12. The ski brake has a pair of spring-steel wire loops 203 each having a leg or slide section 202 and a pivot section 201. A pair of transversely and axially aligned passages 204 in a support or mounting plate 205 define a pivot axis A for a section 201 which extends parallel to the upper and lower surfaces of ski 211 and perpendicular to direction D. In addition, each wire loop has extending perpendicularly from the respective pivot section 201, a leg or end section 206 carrying a synthetic-resin bar or body 207 comprising the brake element according to this invention.

More particularly, each loop 203 has a bight formed by a succession of straight sections 208, 209 and 210. Section 208 extends from the pivot section 201 to section 209 and is normally parallel to section 201, and section 210 has an end forming the slide section 202. In the braking position illustrated in FIGS. 12, 13 and 18, the bight formed by the various sections 208–210 stands up from ski 211, but in the rest or skiing position of FIGS. 14–16 and 19 these sections 208–210 are generally coplanar.

The mounting plate 205 is secured to ski 211 by screws 212, and is generally T-shaped, having a pair of laterally outgoing extending tabs 216 each forming a longitudinally throughgoing passage 213 receiving respective slide section 202. The wires forming loops 203 are each formed between respective sections 210 and respective slide sections 202 with a pair of offset elbows 231 separating a short section 230 so that the end section 202 is parallel to but offset from respective section 210. Each passage 213, furthermore, has an upper part 214 and a lower part 215 that are convex, respectively, downwardly and upwardly so that passage 213 is of a hyperbolic shape, flaring in both directions. In the rest position, slide section 202 bears upwardly on upper side 214 of passage 213, but in the braking position the outmost elbow 231 engages a correspondingly shaped surface of upper edge 214, inhibiting further forward displacement of slide section 202.

Figure 14:
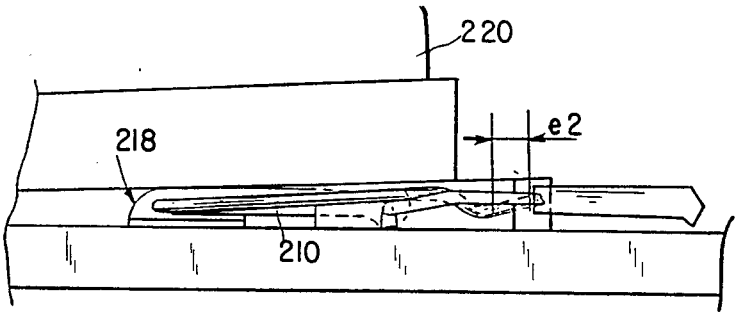
Figure 15:
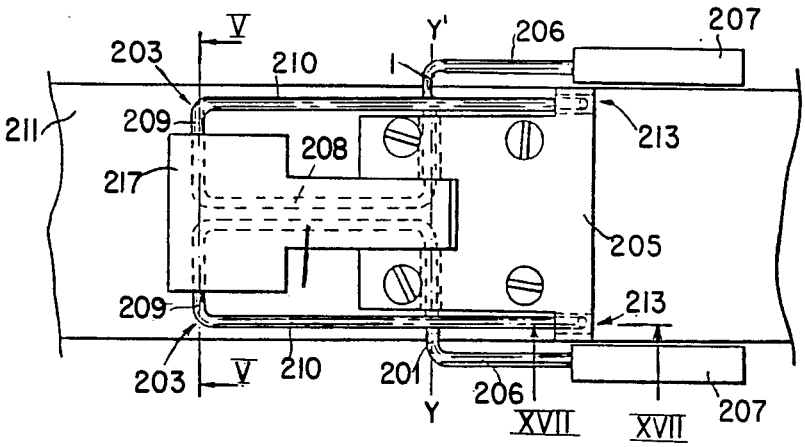
Figure 16:
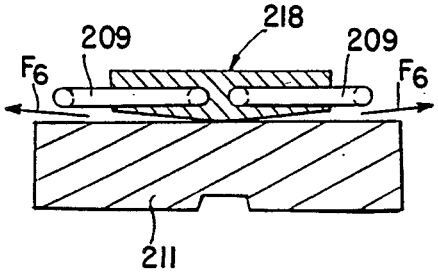
Figure 17:
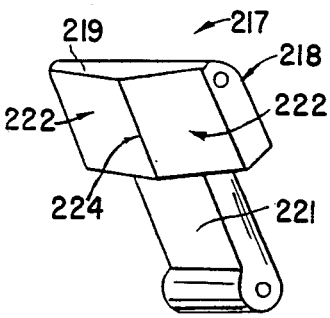

Furthermore, as is illustrated in FIGS. 12–19, the two parts of the ski brake are jointly operated by means of a common actuating step-on plate or pedal 217 that is generally T-shaped and is molded around sections 208 and 209. This pedal 217, as illustrated in FIGS. 16 and 17, has a wide end 218 and a narrow end 221, this narrow end 221 being received in a notch or cutout 223 formed in base plate 205. Further, as illustrated in FIG. 17, the underside of this pedal 218 has central ridge 224 flanked by a pair of incline surfaces 222 so that if there is snow on top of ski 211 and pedal 217 is depressed down against it this snow will be pushed aside as is indicated in FIG. 16 by arrow F6. Furthermore, the upper forward end of wide portion 218 of pedal 217 is rounded at 219 so that when ski boot 220 engages downwardly on it, it will be able to slide smoothly forwardly on the lower surface of the sole of ski boot 220.

Figure 13:
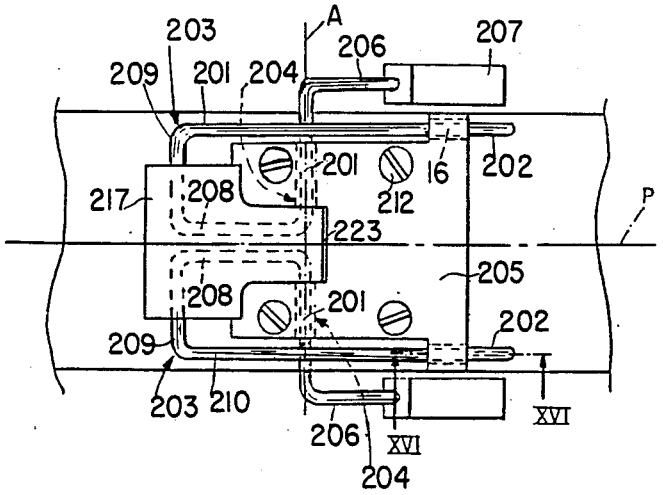
Figure 18:
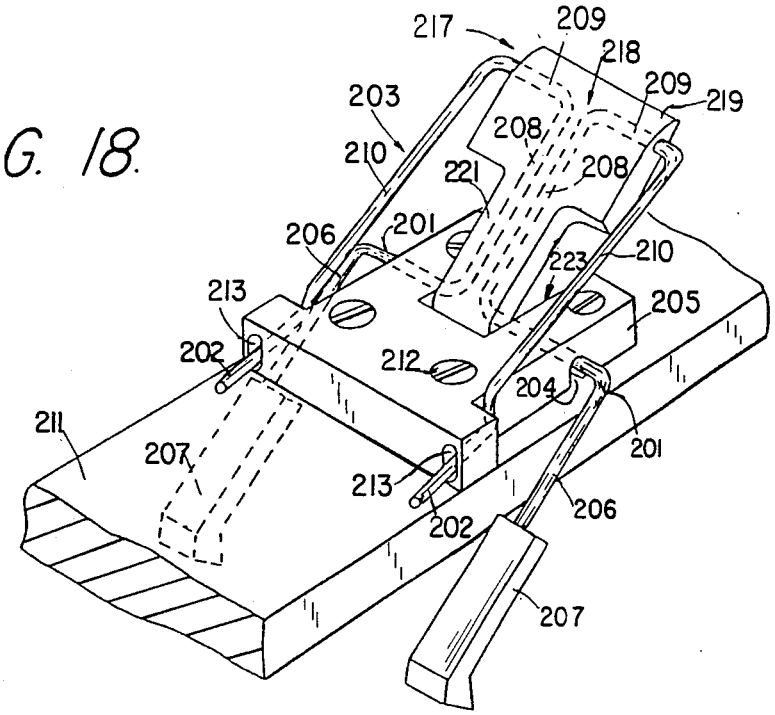
Figure 19:
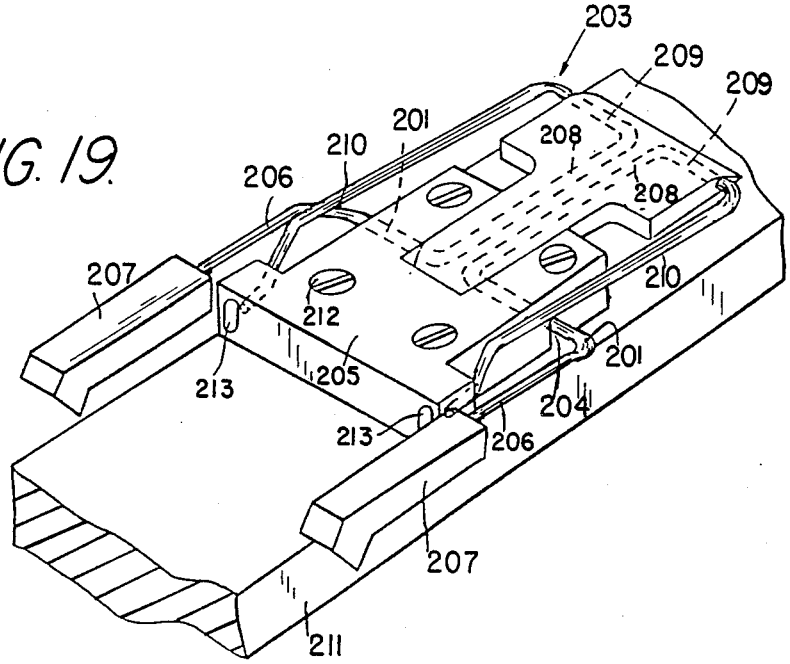

Thus, the device normally stands in the position illustrated in FIGS. 12, 13 and 18. When a ski boot 220 engages downwardly in the direction F of FIG. 12 on the rounded portion 219, this action will displace section 209 downwardly toward the ski as is illustrated by arrow F1, opposite the direction of arrow F3 in which the biasing forces in the loops 203 urge it upwardly. This action will displace brake element 207 forwardly and upwardly to a position above the lower surfaces of the ski as is illustrated in FIGS. 14 and 15. Pivot section 201 lies ahead of passages 213 by a distance 1 and the radii are such that displacing the ski brake from the braking to the rest position moves sections 209 backwardly through the distance e1 which is somewhat smaller than distance 1. Two loops 203 and brake elements 207 symmetrically flank central plane B of the ski so that the two elements 207 will move synchronously and parallel with each other. When the brake is in the braking position illustrated in FIG. 12, backwardly effective forces $F_4$ effective on brake elements 207 will be countered by forces $F_5$ created by the rigidity of the mechanism, with elbows 231 cradled in upper portion 214 of passages 213.

Other applications of the present invention are also possible. They are a function of the type of braking apparatus utilized. For example, in all of known apparatus having a removable latch, the bar or latch must be positioned manually by the skier to block, either a movable element with respect to the base plate or another element integral with the ski. The bar or latch in these known apparatus always has a portion serving as a manipulation means which is to be manipulated by the skier to move the bar or latch. The manipulation means or element is positioned exterior to the assembly of elements of the braking apparatus when the bar is in place, to block the movement of the appropriate elements referred to above. This manipulation means can be configured in a manner such that it comprises an extension which extends into the zone which the boot must sweep during its insertion of the binding. This can be done regardless of the type of braking apparatus.

Figure 7:
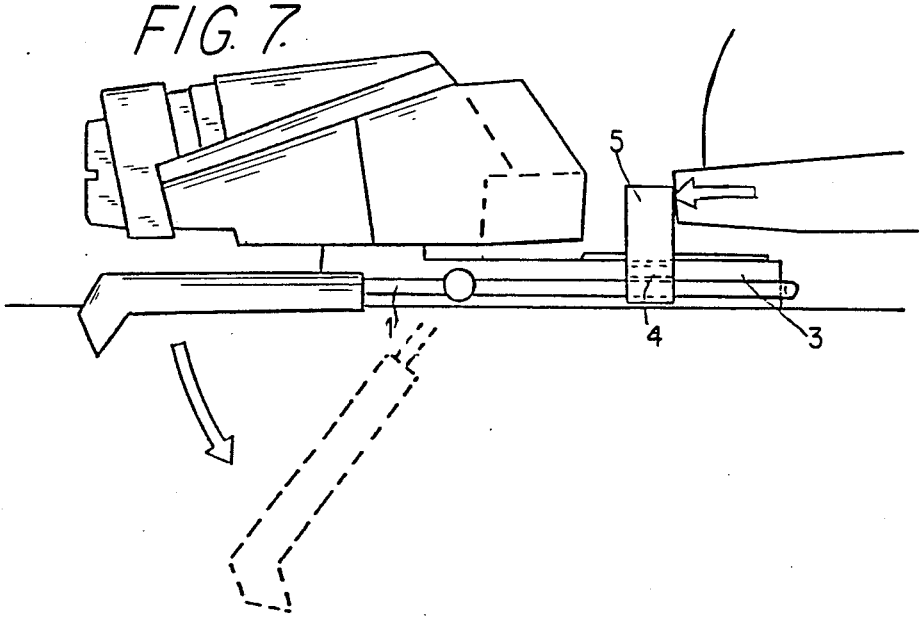

FIG. 7 illustrates an alternative embodiment in which the bar or latching tool or lock comprises an extension arranged in the trajectory of the boot and prevents the longitudinal displacement of the front of the boot which is necessary for introduction of the boot into the front binding. In this embodiment, the brake is positioned at the front abutment and not at the rear abutment, as in the previous embodiments.

Although the invention has been described with reference to particular means, materials and embodiments, it is to be understood that the invention is not limited to the particulars disclosed and extends to all equivalents within the scope of the claims.

What is claimed is:

1. An apparatus for a ski brake wherein said brake is adapted to move from an inactive position to an active position in which said brake brakes a ski having edges thereon after release of a boot from a binding on the ski, and wherein said apparatus comprises:

(a) a latch adapted to be attached to said ski brake to latch said brake in the inactive position; and (b) means for preventing insertion of said boot in said binding, wherein said means is attached to said latch, wherein said boot passes through a zone above said ski when normally inserted into said binding and wherein said means comprises an extension element adapted to extend into said zone when attached to said brake, wherein said extension element is spaced in the longitudinal direction of the ski a distance from said binding.

2. The apparatus defined by claim 1 wherein said latch is removable from said ski brake.

3. The apparatus defined by claim 1 wherein said means comprises an extension element extending substantially vertically upward above said ski, and wherein said latch is positioned between the lateral edges of said ski.

4. The binding defined by claim 1 wherein the bottom of said apparatus is positioned above the sole of said ski.

5. The apparatus defined by claim 1 wherein said element comprises means for extending into said zone only when said brake is in said inactive position.

6. The apparatus defined by claim 1 wherein said apparatus is adapted to permit substantially free access to the edge of said ski, and wherein said extension element is integral with said latch.

7. The apparatus defined by claim 6 wherein said extension element extends substantially perpendicular to said latch.

8. The apparatus defined by claim 7 wherein said latch is removable from said brake.

9. The apparatus defined by claim 8 wherein said latch comprises an inverted substantially T-shaped bar.

10. The apparatus defined by claim 8 wherein said latch comprises a manipulation element adapted to be manipulated by the skier to remove said latch from said brake, wherein said extension comprises said manipulation element.

11. The apparatus defined by claim 6 wherein the longitudinal axis of said latch extends substantially parallel to the longitudianl axis of said brake in said inactive position.

12. The apparatus defined by claim 6 wherein said ski comprises a sole and said brake comprises at least one braking element journalled on a base plate and movable between an active position in which said braking element projects under said sole of said ski, and an inactive position in which said braking element is raised with respect to said ski sole, and wherein said brake further comprises elastic means for biasing said braking element toward said active position and wherein said brake further comprises activation means for activating said braking element to move from said active to said inactive position in response to said boot acting on said activation means against the bias of said elastic means, wherein said activation means is adapted to be positioned in an active position above said ski, and wherein said brake comprises at least two movable elements and wherein said latch further comprises:

a removable bar positioned between said two movable elements to maintain said braking element in said inactive position.

13. The apparatus defined by claim 6 wherein said ski comprises a sole and said brake comprises at least one braking element journalled on a base plate and movable between an active position in which said braking element projects under said sole of said ski, and an inactive position in which said braking element is raised with respect to said ski sole, and wherein said brake further comprises elastic means for biasing said braking element toward said active position and wherein said brake further comprises activation means for activating said braking element to move from said active to said inactive position in response to said boot acting on said activation means against the bias of said elastic means, wherein said ski comprises an element integral therewith, said wherein said latch further comprises:

a removable bar positioned between said braking element and said element integral with said ski to maintain said braking element in said inactive position.

14. A latching apparatus for a ski brake which brakes a ski having lateral edges after release of a boot from a binding on the ski, wherein said brake is adapted for movement between an active and an inactive position, and wherein said latching apparatus comprises:

(a) locking means for locking said brake in said inactive position; and (b) blocking means for blocking insertion of said boot into said binding, wherein said apparatus is positioned between said lateral edges of said ski, wherein said boot passes through a zone above said ski when inserted into said binding and wherein said blocking means is positioned in said zone, wherein said blocking means is spaced in the longitudinal direction of the ski a distance from said binding.

15. The apparatus defined by claim 14 wherein said blocking means is positioned in front of said binding.

16. The apparatus defined by claim 15 wherein said blocking means is attached to said locking means.

17. The apparatus defined by claim 16 wherein said ski has a sole and wherein the bottom of the apparatus is positioned above the sole of said ski.

18. The apparatus defined by claim 16 wherein said locking means is removable from said brake.

19. The apparatus defined by claim 18 wherein said blocking means comprises a bar substantially perpendicular to the longitudinal axis of said locking means.

20. The apparatus defined by claim 19 wherein said apparatus comprises an inverted substantially T-shaped bar.

21. The apparatus defined by claim 18 wherein said ski comprises a sole and said brake comprises at least one braking element journalled on a base plate and movable between an active position in which said braking element projects under said sole of said ski, and an inactive position in which said braking element is raised with respect to said ski sole, and wherein said brake further comprises elastic means for biasing said braking element toward said active position and wherein said brake further comprises activation means for activating said braking element to move from said active to said inactive position in response to said boot acting on said activation means against the bias of said elastic means, wherein said activation means is adapted to be positioned in an active position above said ski, and wherein said brake comprises at least two movable elements, and wherein said locking means comprises:

a removable bar positioned between said two movable elements to maintain said braking element in said inactive position.

22. An apparatus for a ski brake which brakes a ski after release of a boot from a binding on a ski, wherein said brake is adapted to move from an active to an inactive position, and wherein said ski comprises edges and wherein said apparatus comprises:

(a) latching means for latching said brake in said inactive position; and (b) means for preventing insertion of said boot into said binding when said brake is in said inactive position, wherein said apparatus is adapted to permit substantially free access to the edges of said ski, wherein said boot passes through a zone above said ski when normally inserted into said binding, and wherein said insertion prevention means extends into said zone wherein said insertion prevention means is spaced in the longitudinal direction of the ski a distance from said binding.

23. The apparatus defined by claim 22 wherein said insertion prevention means is attached to said latching means.

24. The apparatus defined by claim 23 wherein said insertion prevention means comprises an element, positioned in front of said binding, to block the entry of said boot into said binding.

25. The apparatus defined by claim 24 wherein said element is positioned between the lateral edges of said ski.

26. The apparatus defined by claim 25 wherein the bottom end of said apparatus is positioned above the sole of said ski.

27. The apparatus defined by claim 25 wherein said apparatus is removable from said brake.

28. The apparatus defined by claim 27 wherein said insertion prevention means comprises a bar extending substantially vertically above said ski when said latching means latches said binding in said inactive position.

29. The apparatus defined by claim 28 wherein said apparatus comprises an inverted substantially T-shaped bar.

30. The apparatus defined by claim 28 wherein said ski comprises a sole and said brake comprises at least one braking element journalled on a base plate and movable between an active position in which said braking element projects under said sole of said ski, and an inactive position in which said braking element is raised with respect to said ski sole, and wherein said brake further comprises elastic means for biasing said braking element toward said active position and wherein said brake further comprises activation means for activating said braking element to move from said active to said inactive position in response to said boot acting on said activation means against the bias of said elastic means, wherein said activation means is adapted to be positioned in an active position above said ski, and wherein said brake comprises at least two movable elements and wherein said latching means comprises:

a removable bar positioned between said two movable elements to maintain said braking element in said inactive position.

31. The apparatus defined by claim 28 wherein said ski comprises a sole and said brake comprises at least one braking element journalled on a base plate and movable between an active position in which said braking element projects under said sole of said ski, and an inactive position in which said braking element is raised with respect to said ski sole, and wherein said brake further comprises elastic means for biasing said braking element toward said active position and wherein said brake further comprises activation means for activating said braking element to move from said active to said inactive position in response to said boot acting on said activation means against the bias of said elastic means, wherein said ski comprises an element integral therewith, and wherein said latching means comprises:

a removable bar positioned between said braking element and said element integral with said ski to maintain said braking element in said inactive position.

* * * * *

UNITED STATES PATENT AND TRADEMARK OFFICE
CERTIFICATE OF CORRECTION

PATENT NO. : 4,676,520

DATED : June 30, 1987

INVENTOR(S) : Denis GASQUET et al.

It is certified that error appears in the above-identified patent and that said Letters Patent is hereby corrected as shown below:

At column 1, line 45, insert ---,--- after "disadvantages".
At column 4, line 61, delete "is" before "in".
At column 7, line 38, change "fo" to ---of---.
At column 8, line 3, delete "the pedal".
At column 8, line 34, delete "," after "which".
At column 11, line 20, change "5 is" to ---bar 5 are---.

Signed and Sealed this

Twentieth Day of August, 1991

*Attest:*

HARRY F. MANBECK, JR.

*Attesting Officer*

*Commissioner of Patents and Trademarks*